US008459582B2

(12) United States Patent
Ohashi et al.

(10) Patent No.: US 8,459,582 B2
(45) Date of Patent: Jun. 11, 2013

(54) SURFACE TREATING METHOD AND DEVICE THEREOF

(75) Inventors: Kazuhito Ohashi, Okayama (JP); Shinya Tsukamoto, Okayama (JP); Hiroyuki Hasegawa, Okayama (JP)

(73) Assignee: National University Corporation Okayama University, Okayama (JP)

( * ) Notice: Subject to any disclaimer, the term of this patent is extended or adjusted under 35 U.S.C. 154(b) by 604 days.

(21) Appl. No.: 12/676,255

(22) PCT Filed: Sep. 2, 2008

(86) PCT No.: PCT/JP2008/065724

§ 371 (c)(1),
(2), (4) Date: Apr. 15, 2010

(87) PCT Pub. No.: WO2009/031517

PCT Pub. Date: Mar. 12, 2009

(65) Prior Publication Data

US 2010/0255759 A1 Oct. 7, 2010

(30) Foreign Application Priority Data

Sep. 3, 2007 (JP) ..... 2007-228276

(51) Int. Cl.
*B02C 13/286* (2006.01)

(52) U.S. Cl.
USPC ..... 241/301

(58) Field of Classification Search
USPC ..... 241/1, 301
See application file for complete search history.

(56) References Cited

U.S. PATENT DOCUMENTS 7,585,665 B2 * 9/2009 Iiyama et al. ..... 435/289.1

FOREIGN PATENT DOCUMENTS

| | | |
|---|---|---|
| JP | 06-047672 | 2/1994 |
| JP | 07-313948 | 12/1995 |
| JP | 2007-075958 | 3/2007 |

OTHER PUBLICATIONS

International Search Report for International Application No. PCT/JP2008/0657424, Japanese Patent Office mailed Dec. 9, 2008, 2 pgs.
"Cavitation Aided Machining for Finishing Glass Surface" The Japan Society of Mechanical Engineers annual meeting vol. 2003 No. 4, The Japan Society of Mechanical Engineers, Aug. 5, 2003, pp. 303-304.
Kazuhito Ohashi, et al., "A microfabrication method using a sucking cavitation flow", Japan Society for Precision Engineering, spring convention, academic lecture meeting, collection of papers, Mar. 1, 2005, Hei 17, pp. 1307 to 1308.

* cited by examiner

*Primary Examiner* — Faye Francis
(74) *Attorney, Agent, or Firm* — Sterne, Kessler, Goldstein & Fox P.L.L.C.

(57) ABSTRACT

In a surface treating method of the present invention, a fluid suction passage 26 communicating with a fluid supply passage 25 via only a narrowed portion 27 is provided, so as to approximately concentrically surround the periphery of the fluid supply passage 25 having the narrowed portion 27 at one end thereof, and the sucking cavitation flow 5 is generated at the direct downstream of the narrowed portion 27, by sucking the processing fluid 8 into the fluid suction passage 26 using a suction pump 17, as well as a surface treating is performed on the treated surface 6*a*, by crushing the sucking cavitation flow 5 approximately perpendicular to the treated surface 6*a*.

10 Claims, 12 Drawing Sheets

SURFACE TREATING METHOD AND DEVICE THEREOF

BACKGROUND OF THE INVENTION

1. Field of the Invention

The present invention relates to a surface treating method and a device thereof for generating air bubbles due to cavitation (hereinafter, referred to as "cavitation bubbles"), by sucking in or suck in and spraying fluid via a narrowed portion provided at midstream of a flow passage, and for acting an impact force caused by crushing the cavitation bubbles (hereinafter, referred to as "a crushing impact force") on a treated surface in the vicinity of the narrowed portion.

2. Background Art

Conventionally, there is well known a technology for performing a surface modification which improves material property such as fatigue strength, by processing a surface of a nonmetallic material such as a metal material, a plastic, a glass or a semiconductor due to local material removal such as grind, or by pressing the surface thereof so as to add compressive stress to it, or alternatively, for performing various treatments such as the processing, the surface modification, the washing (hereinafter, referred to as "a surface treating"), by vigorously spraying a jet flow of high pressure fluid containing the cavitation bubbles (hereinafter, referred to as "a spraying cavitation flow") onto the surface of the treated material (hereinafter, referred to as "a treated surface") and by acting the treated surface on the crushing impact force of the cavitation bubbles, for the purpose of removing and washing attached impurities. The surface treating technology can deal with previous problems, such as the problem of environmental pollution, device corrosion due to wet etching which uses etching fluid having high oxidation nature, the problem of difficulty in applying to the severe working environment, the surface roughening of a low intensity member due to a blast process for intensively blasting fine abrading agent or the like together with high-pressure air, the problem of increasing size of a pump or the like, increasing cost of devices due to a water-jet machining for performing a cutting by using a jet flow of high-pressure water through small holes or the like, and the problem of difficulty in applying to complicated shapes due to machining process such as cutting, grinding, polishing.

As a result of keen examinations, the inventers or the like disclose the surface treating technology, which generates a flow with the cavitation bubbles, by sucking in processing fluid with a pump and by locally limiting a flow of the processing fluid while sucking in by a narrowed portion provided on the processed surface, so as to cause the cavitation at the downstream side of the narrowed portion, and which applies a flow of the processing fluid containing the cavitation bubbles generated at this time (hereinafter, referred to as "a sucking cavitation flow") to the processed surface (for example, see nonpatent literature 1). According to the surface treating technology, an influence of excess localized pressure due to the jet flow of the processing fluid can be minimized, and a surface roughening of the processed surface remains small, so as to perform the high-precision processing, unlike in the previous case of locally, vigorously spraying the spraying cavitation flow onto the processed surface. Further, colliding force when particulates on which the crushing impact force acted clashes with the processed surface is added, except for the crushing impact force of the cavitation bubbles, by distributing and mixing the particulates to the processing fluid, so that a processing efficiency of the processed surface can be significantly improved.

Nonpatent literature 1: Kazuhito OHASHI, et al., "A microfabrication method using a sucking cavitation flow", Japan Society for Precision Engineering, spring convention, academic lecture meeting, collection of papers, 2005 Mar. 1, Hei 17, pp 1307 to 1308.

DISCLOSURE OF INVENTION

Problems to be Solved by the Invention

However, in the surface treating technology using the sucking cavitation flow, a plate-like processed material is immersed into a chamber filled with the processing, and the chamber is arranged between the right and left side walls with a wide movable member close to the processed surface of the processed material, so as to provide a narrowed portion as a narrow space between the lower portion of the movable member and the processed surface. In the chamber, a suction port is provided at one side of front-rear direction thereof, and a supply port is provided at the other side of front-rear direction thereof, across the movable member. The supply port and the suction port are communicated therebetween with an outer line, and the processing fluid is sucked from the suction port to into the outer line by a suction pump, so that the processing fluid into the chamber passes through the narrowed portion and flow to the suction port, so as to generate the sucking cavitation flow at the direct downstream of the narrowed portion. At this state, the processing operation by the sucking cavitation flow is applied to the processed surface, by moving back and forth the movable member approximately parallel to the processed surface.

Consequently, in the control configuration, when spreading the space between the right and left side walls, the flow condition of the processing fluid varies widely according to the position in the width direction, and the sucking cavitation flow generated at the narrowed portion is not stabilized, leading to the problem of making it difficult to apply the large processed material. Further, at the narrowed portion, in the vicinity of the right and left side walls, since a disturbance of the flow due to the shear flow grows wider, and the crushing impact force due to the sucking cavitation flow and the colliding force of the particulates are remarkably increased, the processing operation according to the same condition is performed at only the limited range, leading to the problem of making it difficult to evenly process over the while processed surface.

The sucking cavitation flow generated at the direct downstream of the narrowed portion is influenced by the flow of the processing fluid into the chamber, and flows approximately parallel to the processed surface, whereby both of the cavitation bubbles and the particulates move at high speed approximately parallel to the treated surface. For this reason, the cavitation bubbles cannot approach near the treated surface, and the crushing impact force of the cavitation bubbles cannot be fully acted on the treated surface. The particulates received the crushing impact force crush into the processed surface not vertically but obliquely, and also move apart from the narrowed portion at high speed without accumulating, so that a small number of particulates can receive the crushing impact force. Accordingly, the crushing impact force of the cavitation bubbles and the colliding force by the particulates received the crushing impact force cannot fully act on the treated surface, leading to the problem of being difficult to obtain a high treatment efficiency.

BRIEF SUMMARY OF THE INVENTION

Means for Solving the Problems

In a surface treating method of the present invention, which generates a sucking cavitation flow containing the cavitation bubbles, by sucking in fluid via a narrowed portion provided at midstream of a flow passage, and which acts a crushing impact force of the cavitation bubbles on a treated surface in the vicinity of the narrowed portion, into the sucking cavitation flow, a fluid suction passage communicating with a fluid supply passage via only the narrowed portion is provided, so as to approximately concentrically surround the periphery of the fluid supply passage having the narrowed portion at one end thereof, and the sucking cavitation flow is generated at the direct downstream of the narrowed portion, by sucking the fluid into the fluid suction passage using a suction means, as well a surface treating is performed on the treated surface, by crushing the sucking cavitation flow approximately perpendicular to the treated surface.

The surface treating method of the present invention crushes particulates approximately perpendicular to the treated surface, by distributing and mixing the particulates with the fluid and by acting the particulates on the crushing impact force of the cavitation bubbles.

In the surface treating method of the present invention, the fluid into the fluid suction passage is sucked using the suction means, and the fluid into the fluid supply passage is pressurized and sent using a pressure feeding means.

In the surface treating method of the present invention, the narrowed portion is opened, after sucking the fluid into the fluid supply passage using the suction means and increasing an inner pressure into the fluid supply passage than an inner pressure into the fluid suction passage, with the narrowed portion preliminarily closed.

In the surface treating method of the present invention, a temperature of the fluid is controlled at the given temperature.

In a surface treating device of the present invention, comprising a narrowed portion at midstream of a flow passage for a fluid, which is equipped with a construction that generates a sucking cavitation flow containing a cavitation bubbles, by sucking the fluid via the narrowed portion and acts a crushing impact force of the cavitation bubbles on a treated surface in the vicinity of the narrowed portion in the sucking cavitation flow, the surface treating device comprises a fluid supply passage, which has the narrowed portion at one end thereof and which can supply the fluid with the narrowed portion, a fluid suction passage communicating with the fluid supply passage via only the narrowed portion, and a suction means which sucks the fluid in the fluid suction passage, wherein the fluid suction passage approximately concentrically surrounds the periphery of the fluid supply passage, and wherein the narrowed portion is arranged opposite to the treated surface.

The surface treating device of the present invention crushes particulates approximately perpendicular to the treated surface, by distributing and mixing the particulates with the fluid and by acting the particulates on the crushing impact force of the cavitation bubbles.

In the surface treating device of the present invention, a single tube body is provided therein with the fluid supply passage and is provided at one end thereof with the narrowed portion, and the treated surface is exposed into the fluid suction passage at the outer side of the single tube body.

In the surface treating device of the present invention, a double tube body, integrally consisting of an inner tube having the fluid supply passage therein and having the narrowed portion at one end thereof, and an outer tube having the fluid suction passage during the outer side surface of the inner tube, is provided, and the treated surface is exposed into the fluid passage in the vicinity of the narrowed portion.

In the surface treating device of the present invention, the outer tube is extended so as to cover the fluid passage from the narrowed portion to the treated surface.

The surface treating device of the present invention comprises a distance retaining means which can retain the distance from the narrowed portion to the treated surface.

The surface treating device of the present invention comprises a distance sensor which can detect the distance from the narrowed portion to the treated surface.

In the surface treating device of the present invention, the treated surface is covered at an untreated portion thereof with a masking member.

In the surface treating device of the present invention, the narrowed portion is configured so as to be freely movable on the treated surface.

In the surface treating device of the present invention, the narrowed portion is provided near a downstream opening portion thereof with a porous member having multiple pores.

In the surface treating device of the present invention, the narrowed portion is provided near the downstream opening portion thereof with an inducing member for inducing the sucking cavitation flow to the given direction.

In the surface treating device of the present invention, the narrowed portion is provided near the downstream opening portion thereof with a fluid swirling means.

In the surface treating device of the present invention, the narrowed portion is provided with a pore diameter variable means for changing a pore diameter of the narrowed portion.

Effect of the Invention

As results of the present invention, in a surface treating method of the present invention, which generates a sucking cavitation flow containing cavitation bubbles, by sucking in fluid via a narrowed portion provided at midstream of a flow passage, and which acts a crushing impact force of the cavitation bubbles on a treated surface in the vicinity of the narrowed portion, into the sucking cavitation flow, a fluid suction passage communicating with a fluid supply passage via only the narrowed portion is provided, so as to approximately concentrically surround the periphery of the fluid supply passage having the narrowed portion at one end thereof, and the sucking cavitation flow is generated at the direct downstream of the narrowed portion, by sucking the fluid into the fluid suction passage using a suction means, as well as a surface treating is performed on the treated surface, by crushing the sucking cavitation flow approximately perpendicular to the treated surface. Accordingly, the flow condition of the fluid near the narrowed portion is not greatly varied depending on the circumferential position of the cross section of the narrowed portion, the stable sucking cavitation flow can be generated at the direct downstream of the narrowed portion, so that the even surface treating can be performed over the whole treated surface, and the stable surface treating can be performed for a large treated material, so as to be able to improve a processing accuracy and to enlarge the treating size. Because the sucking cavitation flow is crushed approximately perpendicular to the treated surface, whereby the cavitation bubbles into the sucking cavitation flow can be approached at least near the treated surface, and the crushing impact force of the cavitation bubbles can be significantly acted on the treated surface, so as to enhancing a processing efficiency.

The surface treating method of the present invention crushes particulates approximately perpendicular to the treated surface, by distributing and mixing the particulates with the fluid and by acting the particulates on the crushing impact force of the cavitation bubbles. Accordingly, the colliding force that the treated surface received from the particulates increases, a vortex due to the water flow flown out of the narrowed portion and the reversed flow thereof is generated, near the treated surface at which the flow direction of the fluid widely varies, and the particulates remain at a stagnation caused into the vortex, so that the number of the particulates receiving the crushing impact force increases, so as to fully strength the colliding force by the particulates and to further improve the processing efficiency.

The fluid into the fluid suction passage is sucked using the suction means, and the fluid into the fluid supply passage is pressurized and sent using a pressure feeding means, thereby being able to crush the sucking cavitation flow more intensively onto the treated surface, so as to enhance the surface treating speed and the processing speed.

The narrowed portion is opened, after sucking the fluid into the fluid supply passage using the suction means and increasing an inner pressure in the fluid supply passage than an inner pressure in the fluid suction passage, with the narrowed portion preliminarily closed, thereby being able to crush the high pressure sucking cavitation flow onto the treated surface, so as to enhance the surface treating speed and the processing speed.

The temperature of the fluid is controlled at the given temperature, thereby being able to control the temperature to the temperature state easy to generate the cavitation bubbles and to increase the cavitation bubbles, so as to improve the surface treating efficiency.

In a surface treating device, comprising a narrowed portion at midstream of a flow passage for a fluid, which is equipped with a construction that generates a sucking cavitation flow containing cavitation bubbles, by sucking the fluid via the narrowed portion and acts a crushing impact force of the cavitation bubbles on a treated surface in the vicinity of the narrowed portion in the sucking cavitation flow, the surface treating device comprises a fluid supply passage, which has the narrowed portion at one end thereof and which can supply the fluid with the narrowed portion, a fluid suction passage communicating with the fluid supply passage via only the narrowed portion, and a suction means which sucks the fluid into the fluid suction passage, wherein the fluid suction passage approximately concentrically surrounds the periphery of the fluid supply passage, and wherein the narrowed portion is arranged opposite to the treated surface. Accordingly, the flow condition of the fluid near the narrowed portion is not greatly varied depending on the circumferential position of the cross section of the narrowed portion, the stable sucking cavitation flow can be generated at the direct downstream of the narrowed portion, so that the even surface treating can be performed over the whole treated surface, and the stable surface treating can be performed for a large treated material, so as to be able to improve a processing accuracy and to enlarge the treating size. Because the sucking cavitation flow is crushed approximately perpendicular to the treated surface, whereby the cavitation bubbles into the sucking cavitation flow can be approached at least near the treated surface, and the crushing impact force of the cavitation bubbles can be significantly acted on the treated surface, so as to enhancing a processing efficiency. The above-mentioned effects can be achieved, only by providing the simple construction that the narrowed portion is arranged opposite to the treated surface.

The surface treating device of the present invention crushes particulates approximately perpendicular to the treated surface, by distributing and mixing the particulates with the fluid and by acting the particulates on the crushing impact force of the cavitation bubbles. Accordingly, the colliding force that the treated surface received from the particulates increases, a vortex due to the water flow flown out of the narrowed portion and the reversed flow thereof is generated, near the treated surface at which the flow direction of the fluid widely varies, and the particulates remain into the vortex, so that the number of the particulates receiving the crushing impact force increases, so as to fully strength the colliding force by the particulates and to further improve the processing efficiency.

In the surface treating device, the single tube body is provided therein with the fluid supply passage and is provided at one end thereof with the narrowed portion, and the treated surface is exposed into the fluid suction passage at the outer side of the single tube body. Accordingly, the sucking cavitation flow generated at the direct downstream of the narrowed portion can be applied on the treated surface, by a simple construction that only arranges the single tube body, for example, with the narrowed portion come close onto the treated surface of the treated material immersed into a chamber, thereby being able to reduce the device cost and improve the maintenance performance.

Since the single tube body is made up of a flexible pipe, the sucking cavitation flow generated at the direct downstream of the narrowed portion can be applied to the given portion of the treated surface, by bending the single tube body along the shape of the flow passage component of the fluid suction passage which the treated surface is exposed therein. Even if the flow passage component is not a linear shape but is inflective or a complicated shape, the surface treating can be performed by swiftly and accurately moving the narrowed portion to the given portion, thereby being able to secure the high treatment efficiency and processing accuracy and to expand the processing object.

The double tube body, integrally consisting of an inner tube having the fluid supply passage therein and having the narrowed portion at one end thereof, and an outer tube having the fluid suction passage during the outer side surface of the inner tube, is provided, and the treated surface is exposed into the fluid passage in the vicinity of the narrowed portion. Accordingly, the surface treating can be applied onto the treated surface, by only changing the position of the double tube body provided with the fluid supply passage and the fluid suction passage into the chamber, even the case when a large chamber is required so as to immerse the large treated material, a cross-sectional area of the fluid suction passage surrounding the fluid supply passage is significantly increased, and when a sufficient suction power cannot be obtained by a normal suction pump, thereby being able to secure the high processing accuracy and treatment efficiency and to enlarge the processing size The outer side surface of the inner tube comprising the fluid supply passage can be utilized so as to form the fluid suction passage, thereby being able to reduce the component cost due to the decrease in the number of components and to enhancing the maintenance performance. Since the fluid suction passage of the double tube body is defined by the inner tube and outer tube, the shape or largeness of the cross section of the fluid suction passage can be always kept at constant and the variation of the sucking cavitation flow into the fluid suction passage can be restrained.

Because the outer tube is extended so as to cover the fluid passage from the narrowed portion to the treated surface (hereinafter, referred to as "a treated passage", the influence that the sucking cavitation flow in the treated passage receives from the outside thereof can be minimized, and the distance of the treated passage can be set at adequate one, corresponding to the kind or the extent of the surface treating, the kind of the fluid or particulates, the mechanical property of the treated material or the like, by changing the extended length of the outer tube, thereby being able to further advancing the treating efficiency and the processing accuracy of the surface treating.

The surface treating device comprises the distance retaining means which can constantly retain the distance from the narrowed portion to the treated surface, so that the crushing impact force of the cavitation bubbles or the colliding force of the particulates can be evenly acted over the whole treated surface, so as to performing the homogeneous surface treating.

As the surface treating device comprises the distance sensor which can detect the distance from the narrowed portion to the treated surface, the distance from the narrowed portion to the treated surface can be retained at an adequate value with higher accuracy, based on a distance signal from the distance sensor, thereby being able to further advancing the treating efficiency and the processing accuracy.

The treated surface is covered at an untreated portion thereof with a masking member, whereby the surface treating with high processing accuracy can be performed, for example, a microfabrication of complicated shapes onto the surface of an electronic component or an optical component such as a solar panel or a plasma display, an application of the compressive stress to a specific portion of a quenching member or the like, so as to further expand the processing object.

The narrowed portion is configured so as to be freely movable on the treated surface, whereby the sucking cavitation flow generated at the direct downstream of the narrowed portion can be applied to the given portion of the treated surface, by moving the tube body without moving the treated material, and the surface treating can be performed by swiftly and accurately moving the narrowed portion of the tube body to the given portion, thereby being able to secure the high treatment efficiency and processing accuracy and to expand the processing object.

The narrowed portion is provided near an downstream opening portion thereof with a porous member having multiple pores, so as to increase the portions generating the cavitation bubbles, thereby being able to improve a generating efficiency of the cavitation bubbles and to enhance the surface treating efficiency.

The narrowed portion is provided near the downstream opening portion thereof with an inducing member for inducing the sucking cavitation flow to the given direction, so that the sucking cavitation flow can be induced to the given portion of the treated material, so as to enhance the surface treating efficiency.

The narrowed portion is provided near the downstream opening portion thereof with a fluid swirling means, so that the sucking cavitation flow can be swirled toward the treated material to the given direction and can be crushed into it, thereby being able to prevent unevenness of the surface treating and to evenly performing the surface treating.

The narrowed portion is provided with a pore diameter variable means for changing a pore diameter of the narrowed portion, which can continuously adjust the extent of the impact of the sucking cavitation flow on a processed surface of the processed member, so as to control the processing configuration

BRIEF DESCRIPTION OF THE DRAWINGS/FIGURES

DESCRIPTION OF NOTATIONS

Figure 1:
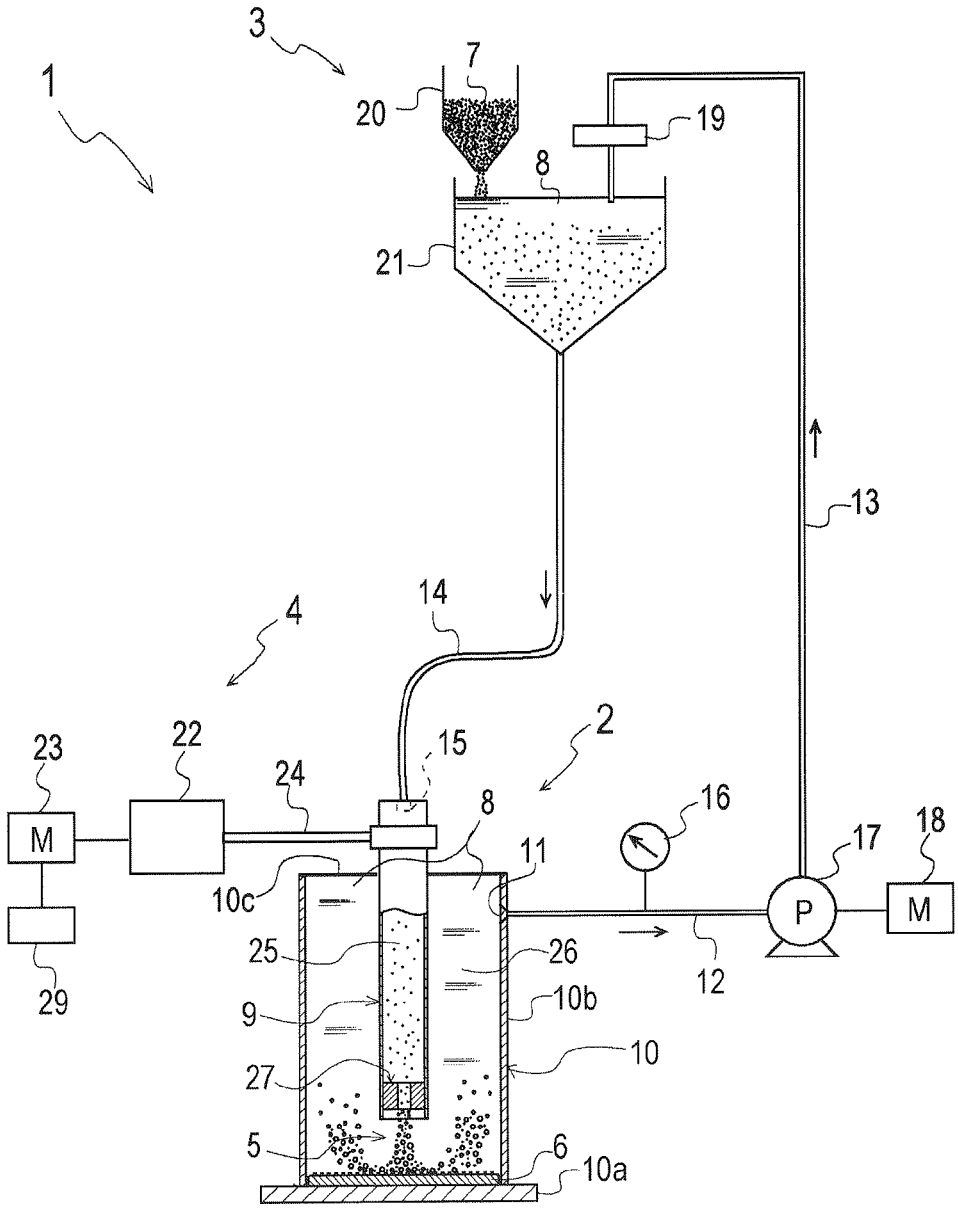
FIG. 1 is a pattern diagram of an entire construction of a surface treating device according to the present invention.

1, 50 a surface treating device
5 a sucking cavitation flow
6*a*, 35*a*, 44*a* a treated surface
7 Particulates
8 a fluid
9, 43 a single tube body
17 a suction means
25, 38 fluid supply passages
26, 39 fluid suction passages
27, 45 narrowed portions
30 cavitation bubbles
31 a masking member
33 a double tube body
36 an inner tube
37 an outer tube
42 a fluid passage from the narrowed portion to the treated surface
42*a*, 52 Distances
51 a distance retaining means
54 a distance sensor
55 a pressure feeding means
60 a porous member
61 an inducing member
63 a fluid swirling means

DETAILED DESCRIPTION OF THE INVENTION

Next, embodiments of the present invention will be described.

Figure 2:
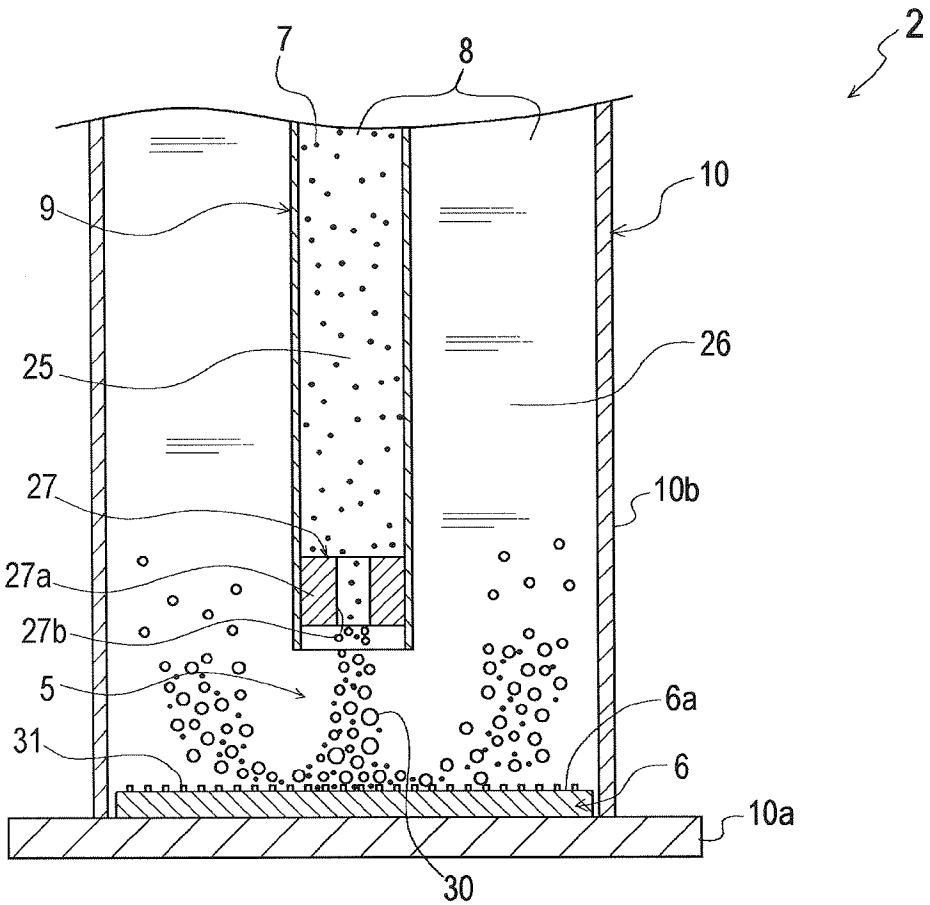
FIG. 2 is a cross sectional side view of a treating portion equipped with a tube body of a single tube type.
Figure 3:
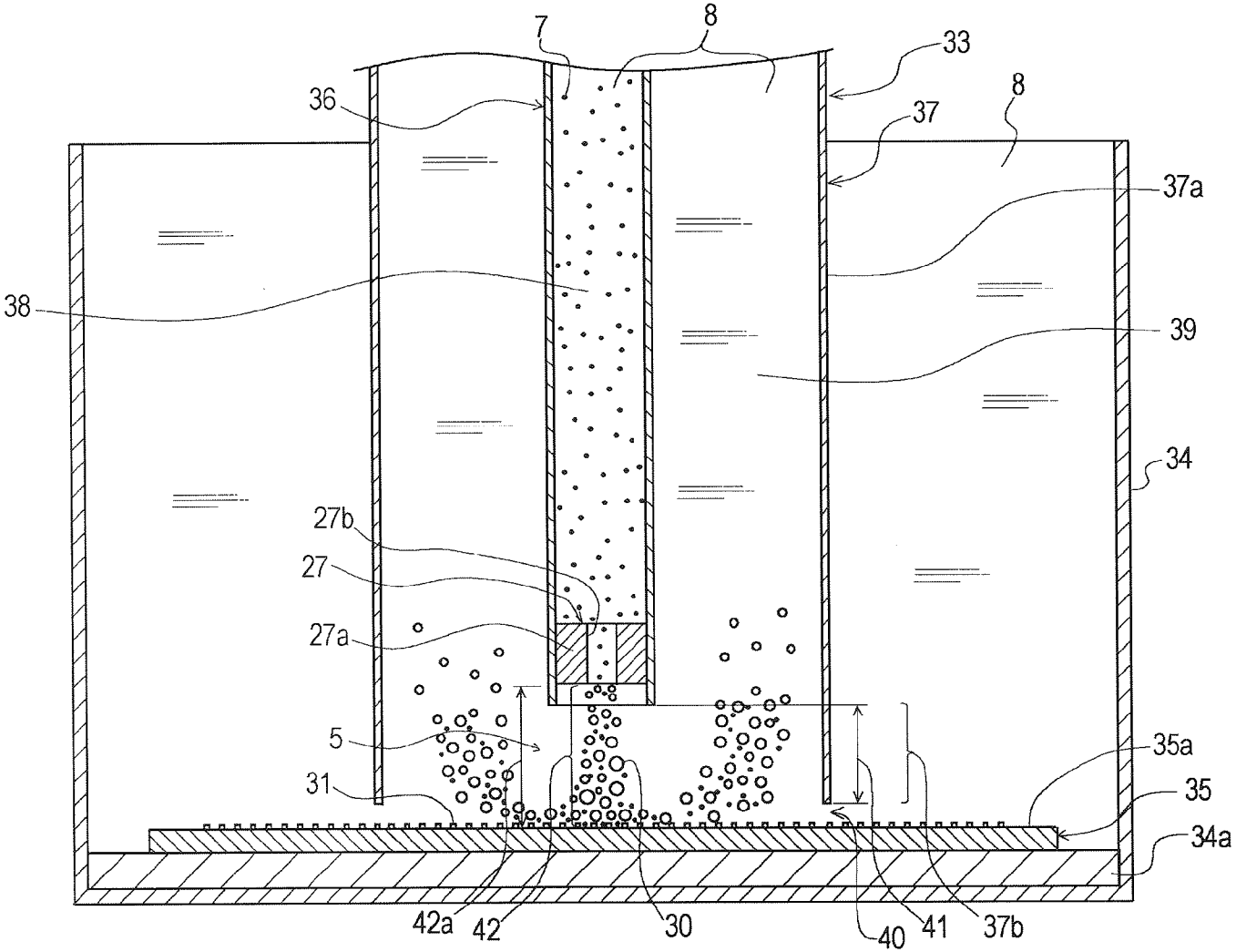
FIG. 3 is a cross sectional side view of a treating portion equipped with a tube body of a double tube type.
Figure 4:
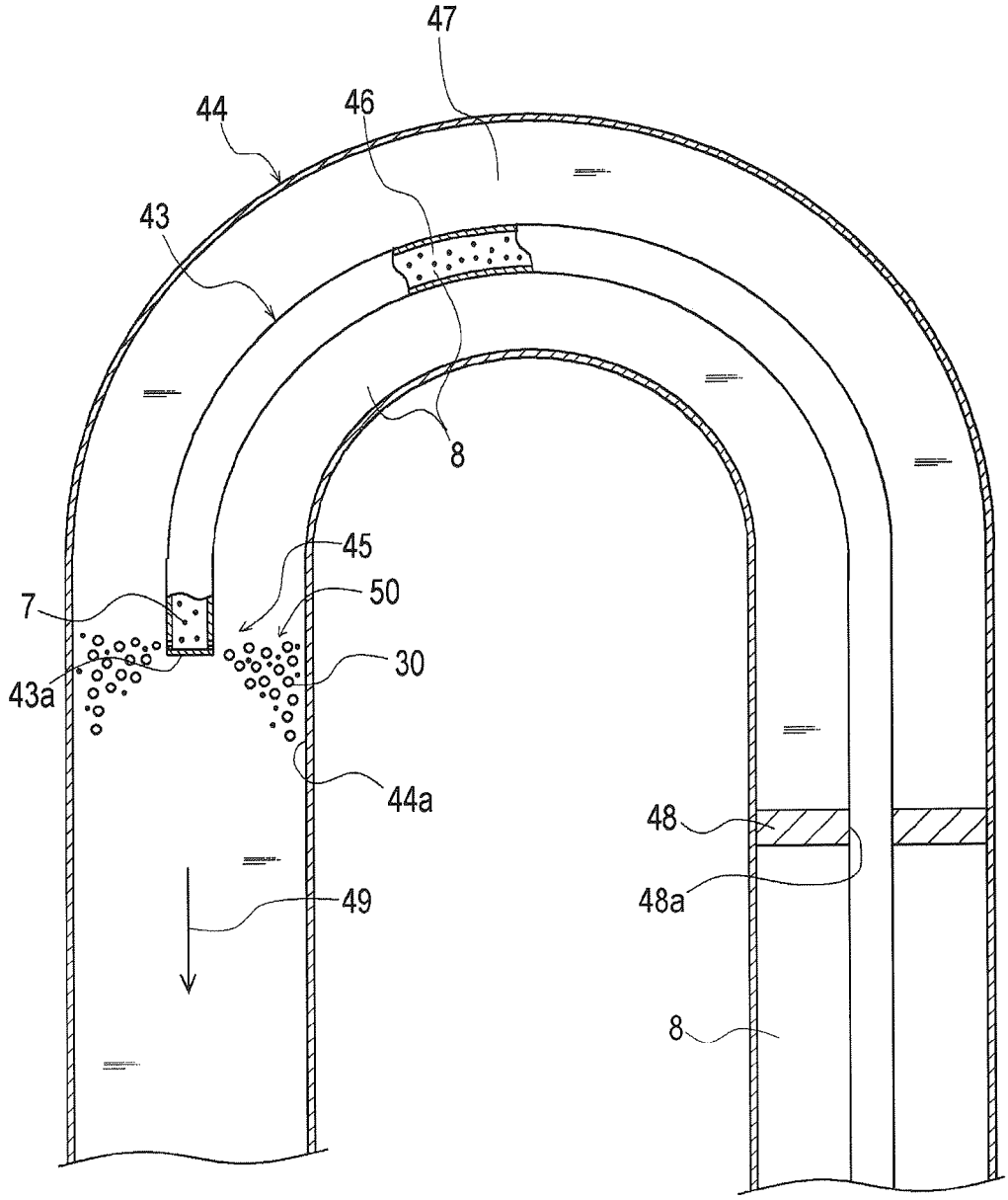
FIG. 4 is a partial cross sectional side view of a treating portion equipped with a tube body of a flexible pipe type.
Figure 5:
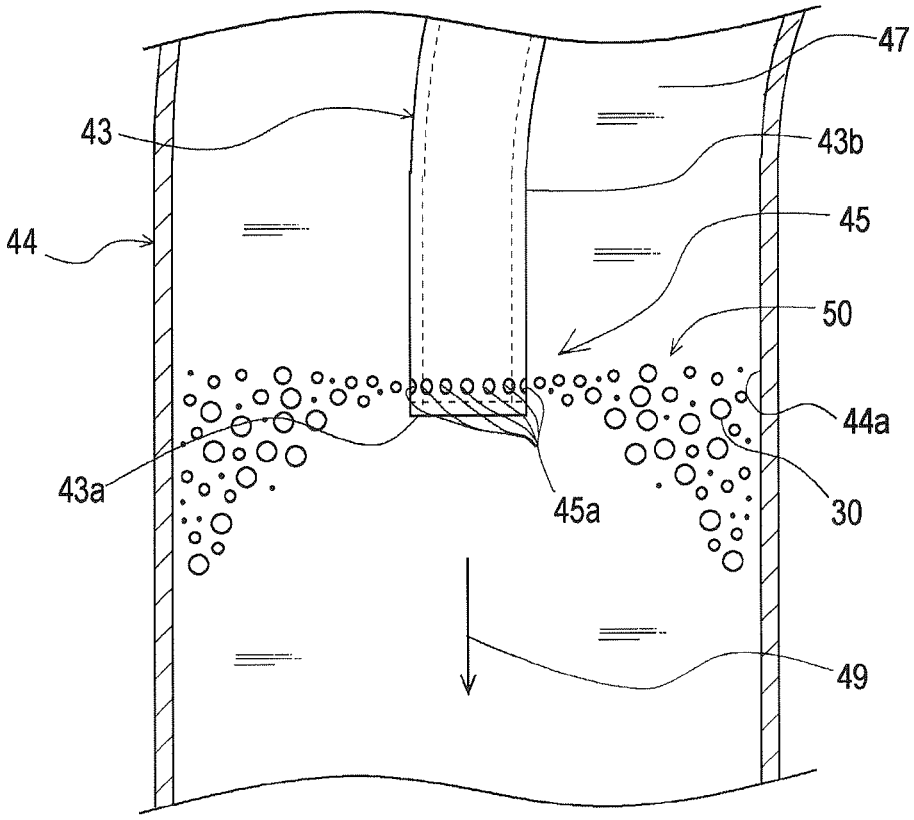
FIG. 5 is a partial cross sectional side view of the vicinity of a narrowed portion at the tube body of the flexible pipe type.
Figure 6:
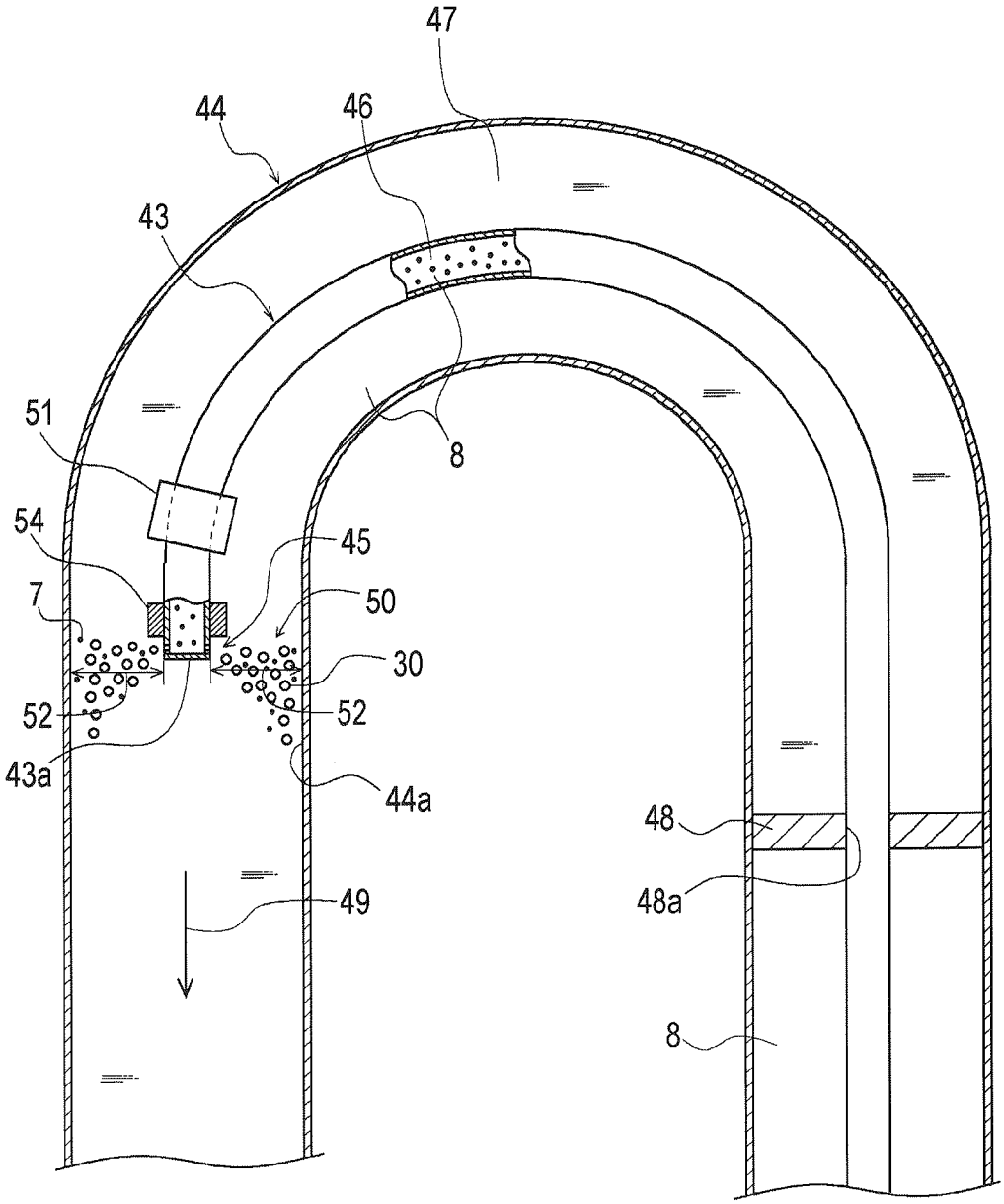
FIG. 6 is a partial cross sectional side view of a treating portion equipped with a tube body of a flexible pipe type having an actuator.
Figure 7:
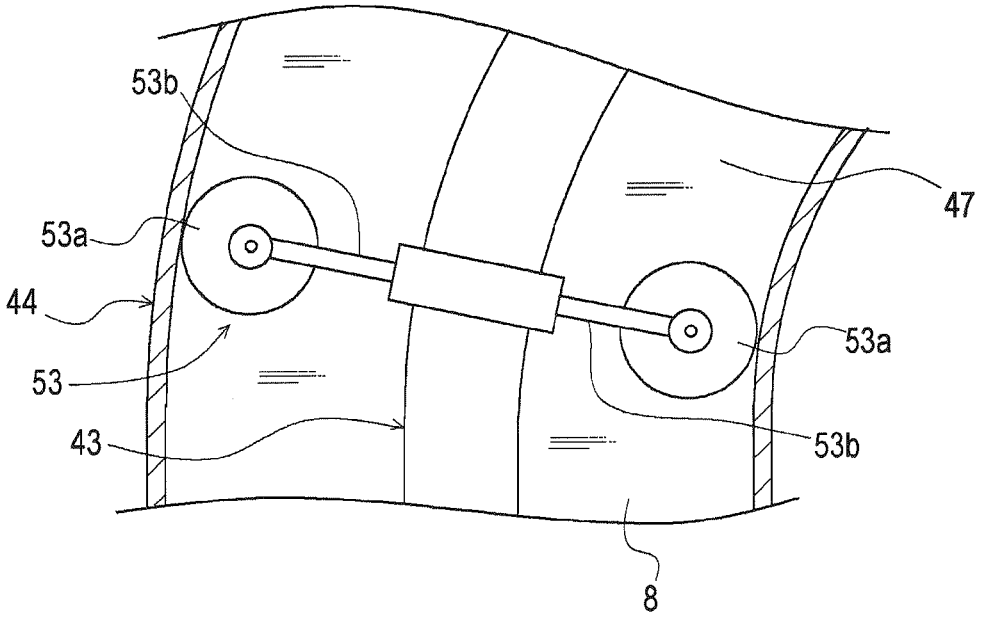
FIG. 7 is a partial cross sectional side view of the vicinity of a supporting member as the actuator.
Figure 8:
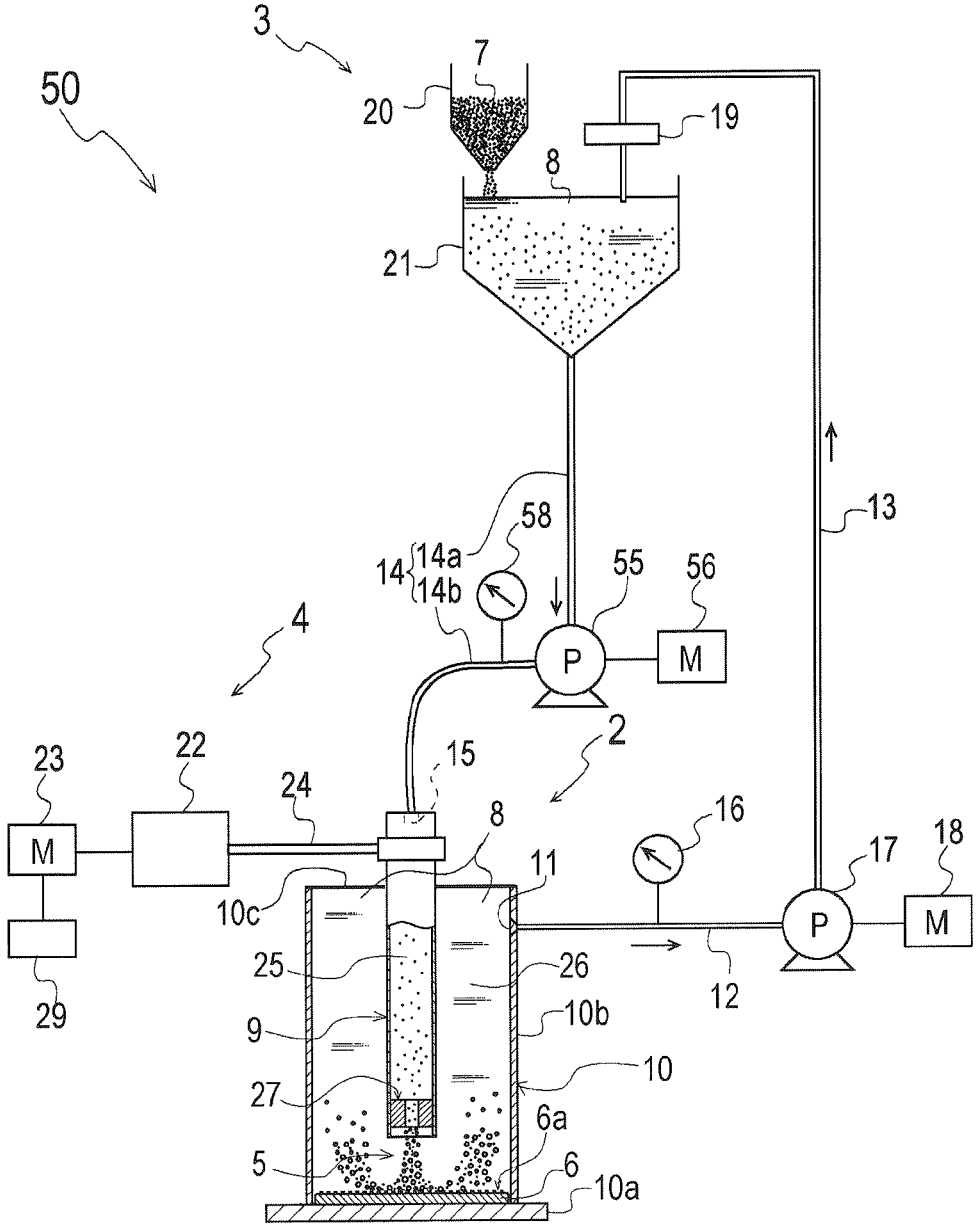
FIG. 8 is a pattern diagram illustrating another embodiment of an entire construction of a surface treating device according to the present invention.
Figure 9:
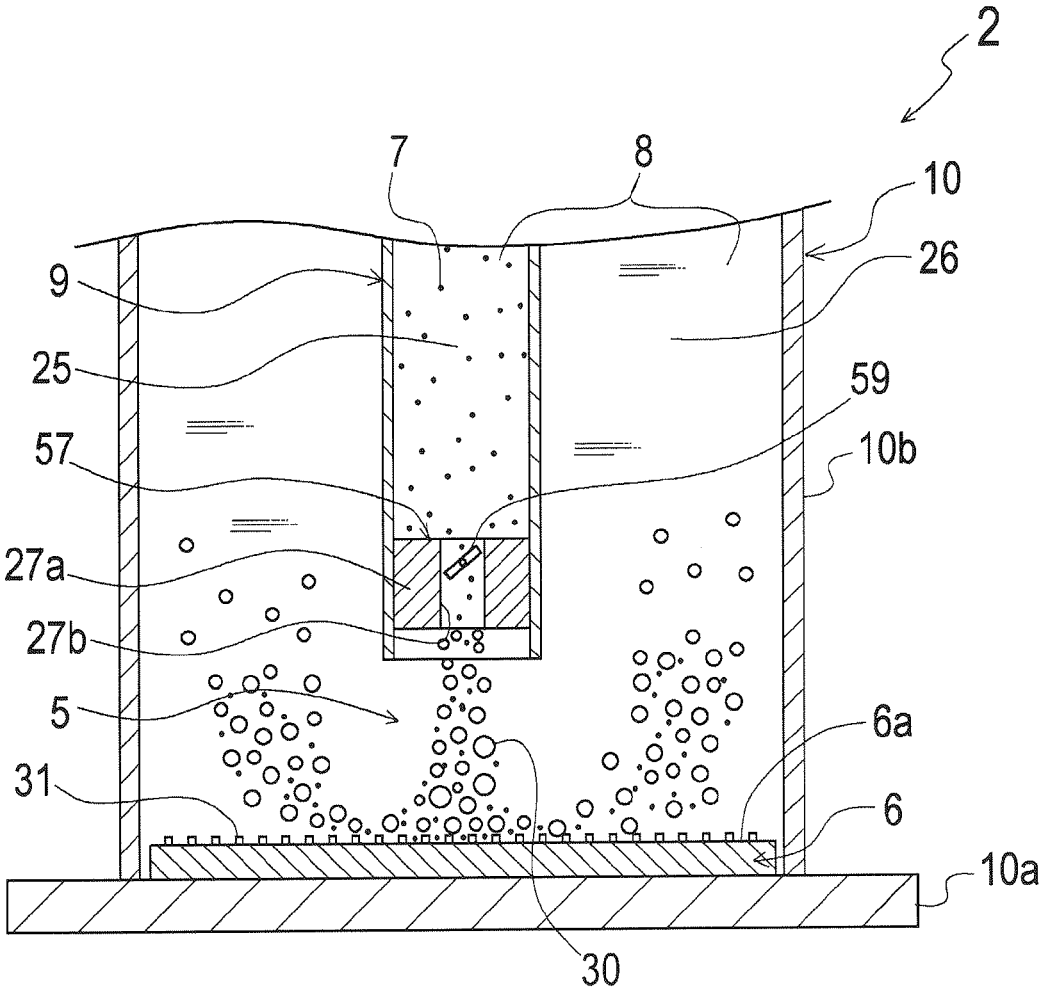
FIG. 9 is a partial cross sectional side view of a narrowed portion equipped with an opening and closing valve.
Figure 10:
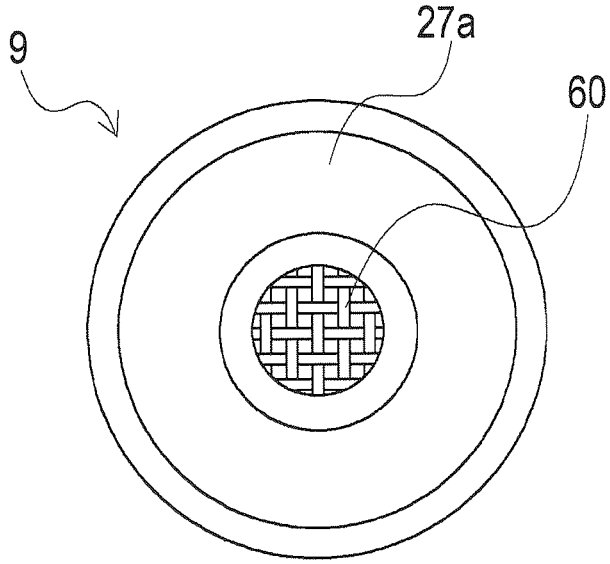
FIG. 10 is a plane view of a mesh member.
Figure 11:
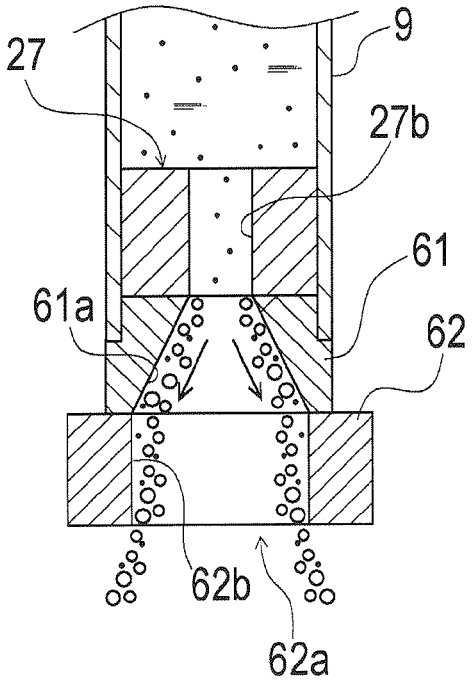
FIG. 11 is a cross sectional side view of a narrowed portion equipped with an inducing member.
Figure 12:
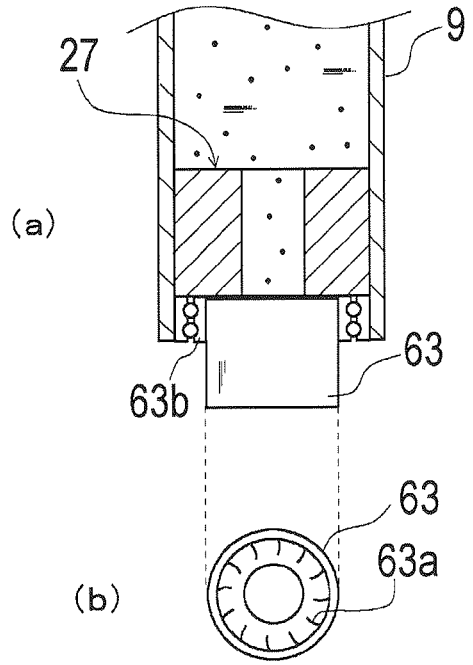
FIG. 12 is a diagram of a narrowed portion equipped with a fluid swirling means, (a) is a partial cross sectional side view, and (B) is a plane view of the fluid swirling means with upward view.

FIG. 1 is a pattern diagram of an entire construction of a surface treating device according to the present invention. FIG. 2 is a cross sectional side view of a treating portion equipped with a tube body of a single tube type. FIG. 3 is a cross sectional side view of a treating portion equipped with a tube body of a double tube type. FIG. 4 is a partial cross sectional side view of a treating portion equipped with a tube body of a flexible pipe type. FIG. 5 is a partial cross sectional side view of the vicinity of a narrowed portion at the tube body of the flexible pipe type FIG. 6 is a partial cross sectional side view of a treating portion equipped with a tube body of a flexible pipe type having an actuator. FIG. 7 is a partial cross sectional side view of the vicinity of a supporting member as the actuator. FIG. 8 is a pattern diagram illustrating another embodiment of an entire construction of a surface treating device according to the present invention. FIG. 9 is a partial cross sectional side view of a narrowed portion equipped with an opening and closing valve. FIG. 10 is a plane view of a mesh member. FIG. 11 is a cross sectional side view of a narrowed portion equipped with an inducing member. FIG. 12 is a diagram of a narrowed portion equipped with a fluid swirling means, (a) is a partial cross sectional side view, and (B) is a plane view of the fluid swirling means with upward view.

First, an entire construction of a surface treating device 1 using a surface treating method according to the present invention will be described, with reference to FIGS. 1 and 2. In this regard, in the present embodiment, a case when performing a microfabrication for a surface of a member in a depth direction will be described. The same construction can be utilized for the surface treating such as the aforementioned surface modification or the washing.

The surface treating device 1 comprises a treating portion 2 for performing a processing treatment by applying a sucking cavitation flow 5 generated to a treated member 6 such as a nonmetallic material, e.g., a metal material, plastics, a glass, a semiconductor, a processing fluid circulating portion 3 for sucking a processing fluid 8 from the treating portion 2, for filtering and removing foreign substances such as coarse processed debris of the treated member 6, as well as for adjusting particulates 7 into the processing fluid 8 and returning it to the treating portion 2, and a tube body driving portion 4 that can move a narrowed portion 27 at the lower end of a tube body 9 in the treating portion 2 in a horizontal direction and a vertical direction.

In the processing fluid circulating portion 3 among them, a suction port 11 opened in a chamber 10 is communicated with a suction port of a suction pump 17 through a pipe 12, and a discharge port of the suction pump 17 is communicated with a storage tank 21 via a pipe 13. By driving the suction pump 17 using a motor 18, the processing fluid 8 into the chamber 10 is swiftly sucked from the suction port 11 into the pipe 12, passes through the pipe 12, the suction pump 17 and the pipe 13 in this order, and the foreign substances such as the coarse processed debris in the processing fluid 8 are removed through a screen filter 19 provided at midstream of the pipe 13, so as to be flown and stored in the storage tank 21.

A powder tank 20 for complementing the particulates 7 lost during the processing or the circulation is provided with the storage tank 21, and the particulates 7 stored into the powder tank 20 are flown into the storage tank 21, when needed, so as to adjusting a mixing ratio of the particulates 7 into the processing fluid 8 to the given value. Although water is normally utilized as the processing fluid 8, washing organic solvents other than the water or the like may be utilized, and the kind of the processing fluid 8 is not especially limited, as long as the processing fluid neither inhibits the generation of the cavitation bubbles nor modifies the treated member 6, the particulates 7, the respective fluid passages, the respective devices or the like. Although hard particulates such as oxides, e.g., alumina, zirconium oxide, carbides, e.g., silicon carbide or the like is normally utilized as the particulates 7, substances that can treat the surface of the treated member 6 by chemical reaction, for example, cerium oxide that can perform the processing with the chemical reaction to the glass into water, even relatively soft particulates, may be utilized. The kind, size, shape, property of the particulates or the like are not especially limited, if the particulates are suitable for the kind of the surface treating applied, the purpose of the treating or the like. Incidentally, the pipe 12 is provided at the midportion thereof with a pressure gauge 16, and the suction pump 17 is controlled so as to be the predetermined suction power by the pressure gauge 16.

Further, the storage tank 21 is communicated at the lower end thereof with a supply port 15 opened in the tube body 9 via a flexible pipe 14. The processing fluid 8 that the particulates 7 are adjusted at the given mixing ratio in the storage tank 21 flows out from the storage tank 21, and flows from the supply port 15 into the tube body 9 through the pipe 14, so as to be supplied to the treating portion 2, whereby the processing fluid circulating structure is configured.

In the tube body driving portion 4, the tube body 9 is connected at the upper portion thereof to one end of a supporting arm 24, and the other end of the supporting arm 24 is connected to an actuator 22. The actuator 22 is attached to a motor 23 connected to a control unit 29. According to a program memorized at the control unit 29, the actuator 22 is driven by the motor 23 so as to move the tube body 9, so that the narrowed portion 27 provided at the lower end of the tube body 9 can be moved to the predetermined position on the treated surface 6*a* of the treated member 6.

Next, the treating portion 2 will be described with reference to FIGS. 1 and 2.

In the treating portion 2, the chamber 10 is placed on a bottom plate 10*a* thereof with a plate-like treated member 6, and the tube body 9 as a single tube type is provided at the position separated by the given distance upward of the treated surface 6*a* of the treated member 6. The tube body 9 is arranged parallel to a tube plate 10*b* making up of the side surface of the chamber 10.

A fluid supply passage 25 is formed inside of the tube body 9. The fluid supply passage 25 is filled with the processing fluid 8 that dispersed and mixed the particulates 7 at the given mixing ratio as mentioned above. The tube body 9 is fitted at the lower end thereof with the narrowed portion 27 including a plug 27*a* perforated a narrowed pore 27*b* at midstream thereof, so that the processing fluid 8 into the fluid supply passage 25 flows out downward through the thin narrowed pore 27*b*. The narrowed portion 27 is located opposite to the treated surface 6*a*, so that the pore axis of the narrowed pore 27*b* is approximately perpendicular to the treated surface 6*a*.

A fluid suction passage 26 is formed around the tube body 9 in the chamber 10. The fluid suction passage 26 is filled with the processing fluid 8. The chamber 10 is liquid-tightly closed at the upper side thereof with a case body 10*c* made from an elastic member such as a rubber so that the tube body 9 penetrating can move in the horizontal direction and the vertical one. Accordingly, while sucking the processing fluid 8 from the suction port 11 by the suction pump 17, remaining air is not mixed into the fluid suction passage 26, so that the suction power of the processing fluid 8 into the fluid suction passage 26 by the suction pump 17 is increased.

Due to the above construction, when driving the suction pump 17, the internal pressure of the fluid suction passage 26 communicated with the suction pump 17 via the pipe 12 becomes a negative pressure, the processing fluid 8 containing the particulates 7 in the fluid supply passage 25 is sucked out approximately perpendicular toward the treated surface 6*a* of the treated member 6, through the narrowed pore 27*b*. Then, the processing fluid 8 increases a flow velocity thereof when passing through the narrowed pore 27*b*, and accordingly, a pressure is lowered, and the pressure is decreased up to the saturated vapor pressure of the processing fluid 8, whereby the cavitation bubbles 30 are generated. Consequently, a high-speed flow of the processing fluid 8 containing the cavitation bubbles 30 is generated at the direct downstream of the narrowed portion 27 as the sucking cavitation flow 5.

The sucking cavitation flow 5 lowers the flow velocity thereof and retrieves the pressure thereof, while it drops from the narrowed pore 27*b* to the treated surface 6*a*, and the cavitation bubbles 30 contained are crushed so as to generate the crushing impact force as mentioned above. The crushing impact force directly acts approximately perpendicular to the treated surface 6*a*, and acts on the particulates 7 moving at high speed to the treated surface 6*a* on the sucking cavitation flow 5, thereby further accelerating the particulates 7 so as to vigorously crushing approximately perpendicular to the treated surface 6*a*.

The processing flow of the sucking cavitation flow 5 that dropped near the treated surface 6*a* gradually spreads outward and changes the flow direction to the reverse one so as to move upwards into the fluid suction passage 26. The vortex is generated between the upward flow and the downward one, and in the vortex, the flow velocity is lowered so as to cause the stagnation, as well as the solid particulates 7 remain at the stagnation, thereby increasing the mixing ratio of the particulates 7 near the treated surface 6*a* and increasing the number of the particulates 7 crushing the treated surface 6*a*.

More specifically, in a surface treating method of the present invention, which generates the sucking cavitation flow 5 containing the cavitation bubbles 30, by sucking in the processing fluid 8 as the fluid via the narrowed portion 27 provided at midstream of the flow passage, and which acts the crushing impact force of the cavitation bubbles 30 on a treated surface 6*a* as the processed surface in the vicinity of the narrowed portion 27, into the sucking cavitation flow 5, a fluid suction passage 26 communicating with a fluid supply passage 25 via only the narrowed portion 27 is provided, so as to approximately concentrically surround the periphery of the fluid supply passage 25 having the narrowed portion 27 at one end thereof, and the sucking cavitation flow 5 is generated at the direct downstream of the narrowed portion 27, by sucking the processing fluid 8 into the fluid suction passage 26 using the suction pump 17 as the suction means, as well a surface treating is performed on the treated surface 6*a*, by crushing the sucking cavitation flow 5 approximately perpendicular to the treated surface 6*a*. Accordingly, the flow condition of the processing fluid 8 near the narrowed portion 27 is not greatly varied depending on the circumferential position of the cross section of the narrowed portion 27, the stable sucking cavitation flow 5 can be generated at the direct downstream of the narrowed portion 27, so that the even surface treating can be performed over the whole treated surface 6*a*, and the stable surface treating can be performed for the treated material 6 as the large treated material, so as to be able to improve a processing accuracy and to enlarge the treating size. Because the sucking cavitation flow 5 is crushed approximately perpendicular to the treated surface 6*a*, whereby the cavitation bubbles 30 into the sucking cavitation flow 5 can be approached at least near the treated surface 6*a*, and the crushing impact force of the cavitation bubbles 30 can be significantly acted on the treated surface 6*a*, so as to enhancing the processing efficiency.

In the device for embodying the surface treating method, comprising a narrowed portion 27 at midstream of a flow passage for the processing fluid 8 as the fluid, which is equipped with a construction that generates the sucking cavitation flow 5 containing the cavitation bubbles 30, by sucking the processing fluid 8 via the narrowed portion 27 and acts the crushing impact force of the cavitation bubbles 30 on the treated surface 6*a* in the vicinity of the narrowed portion 27 in the sucking cavitation flow 5, the surface treating device 1 comprises a fluid supply passage 25, which has the narrowed portion 27 at one end thereof and which can supply the processing fluid 8 with the narrowed portion 27, a fluid suction passage 26 communicating with the fluid supply passage 25 via only the narrowed portion 27, and the suction pump 17 as the suction means which sucks the processing fluid 8 into the fluid suction passage 26, wherein the fluid suction passage 26 approximately concentrically surrounds the periphery of the fluid supply passage 25, and wherein the narrowed portion 27 is arranged opposite to the treated surface 6*a*. Accordingly, the above-mentioned effects due to the surface treating method can be achieved, and these effects can be achieved, only by providing the simple construction that the narrowed portion 27 is arranged opposite to the treated surface 6*a*.

The surface treating device 1 crushes the particulates 7 approximately perpendicular to the treated surface 6*a* as the processed surface, by distributing and mixing the particulates 7 with the processing fluid 8 as the fluid and by acting the particulates 7 on the crushing impact force of the cavitation bubbles 30. Accordingly, the colliding force that the treated surface 6*a* received from the particulates 7 increases, the vortex due to the water flow flown out of the narrowed portion 27 and the reversed flow thereof is generated, near the treated surface 6*a* at which the flow direction of the processing fluid 8 widely varies, and the particulates 7 remain into the vortex, so that the number of the particulates 7 receiving the crushing impact force increases, so as to fully strength the colliding force by the particulates 7 and to further improve the processing efficiency.

As described above, the sucking cavitation flow 5 can be flown from the narrowed portion 27 of the tube body 9 to the treated surface 6*a*, by only arranging the tube body 9 of the single tube type in the fluid suction passage 26 at which the treated surface 6*a* is exposed, and further only the tube body 9 is moved to the given processed portion on the treated surface 6*a*, or is scanned on the treated surface 6*a* at a constant pitch, without moving the treated member 6 placed on the bottom plate 10*a* of the chamber 10, by driving the actuator 22 of the tube body driving portion 4, so as to perform the partial processing or the whole processing of the treated surface.

In the surface treating device, the tube body 9 as the single tube body is provided therein with the fluid supply passage 25 and is provided at one end thereof with the narrowed portion 27, and the treated surface 6*a* as the treated surface is exposed into the fluid suction passage 26 at the outer side of the tube body 9. Accordingly, the sucking cavitation flow 5 generated at the direct downstream of the narrowed portion 27 can be applied on the treated surface 6*a*, by a simple construction that only arranges the tube body 9, for example, with the narrowed portion 27 come close onto the treated surface 6*a* of the treated member 6 as the treated material immersed into a chamber 10, thereby being able to reduce the device cost and improve the maintenance performance.

The narrowed portion 27 is configured so as to be freely movable on the treated surface 6*a* as the processed surface, whereby the sucking cavitation flow 5 generated at the direct downstream of the narrowed portion 27 can be applied to the given portion of the treated surface 6*a*, by moving the tube body 9 without moving the treated member 6 as the treated material, and the surface treating can be performed by swiftly and accurately moving the narrowed portion 27 of the tube body 9 to the given portion, even if the treated member 6 is hard to be moved as it is a heavy load or a fragile material, thereby being able to secure the high treatment efficiency and processing accuracy and to expand the processing object.

As a matter of course, when the treated member 6 is easy to be moved, the tube body 9 may be fixed and the treated member 6 may be moved, or alternatively, the tube body 9 and the treated member 6 may be moved at the same time, the driving construction thereof is not especially limited, as long as the narrowed portion 27 of the tube body 9 can be swiftly and accurately located at the given portion.

The treated surface 6*a* of the present embodiment is covered with the masking member 31 at the predetermined pattern. When the whole surface of the treated surface 6*a* covered is scanned with the tube body 9 at the constant pitch, only the portion that is not covered with the masking member 31 is locally polished and removed by the sucking cavitation flow 5, while the portion that is covered with the masking member 31 (hereinafter, referred to as "the untreated portion") remains without receiving the influence of the sucking cavitation flow 5, and then, the treated surface 6*a* has the given microscopic shape, by removing the masking member 31.

In this regard, the masking can be performed, by attaching an organic film such as polyester, or metal film such as a stainless thin plate having the etching, an electroformed nickel, as the masking member, or alternatively, by photoresist or printing mask. The kind of the masking is not especially limited, as long as it can endure the crushing impact force of the cavitation bubbles 30 and the colliding force of the particulates 7, and can achieve the given processing accuracy.

More specifically, The treated surface 6*a* as the processed surface is covered at the untreated portion thereof with the masking member 31, whereby the surface treating with high processing accuracy can be performed, for example, a microfabrication of complicated shapes onto the surface of the electronic component or the optical component such as the solar panel or the plasma display, an application of the compressive stress to the specific portion of a quenching member or the like, so as to further expand the processing object.

Next, another embodiment of the tube body 9 will be described with reference to FIG. 3.

A tube body 33 is a double tube type including an inner tube 36 equivalent to the tube body 9 and an outer tube 37 equivalent to the chamber 10, and the tube body 33 itself has a fluid supply passage and a fluid suction passage.

The tube body 33 is configured integral with the inner tube 36 and the outer tube 37 that concentrically surrounds the inner tube 36 so as to support and fix it at the upper portion thereof. The inner tube 36 among them is formed therein with a fluid supply passage 38, as is the case with the tube body 9, and the fluid supply passage 38 is filled with the processing fluid 8 in which the particulates 7 are dispersed and mixed. The inner tube 36 is fixed at the lower end thereof with the narrowed portion 27, and the processing fluid 8 into the fluid supply passage 38 is configured so that it flows downward through the narrowed pore 27*b*. The narrowed portion 27 is located opposite to a treated surface 35*a*, so that the pore axis of the narrowed pore 27*b* is approximately perpendicular to the treated surface 35*a*.

Meanwhile, the outer tube 37 and the outer side surface of the inner tube 36 are formed therebetween with a fluid suction passage 39, as is the case with the chamber 10 and the tube body 9. The fluid suction passage 39 is filled with the processing fluid 8, and the outer tube 37 is liquid-tightly closed at the upper portion thereof with a cover body (not shown), so that while sucking the processing fluid 8 from the suction port 11 by the suction pump 17, remaining air is not mixed into the fluid suction passage 39, so as to increase the suction power by the suction pump 17.

Incidentally, the lower end of the outer tube 37 is opened toward the treated surface 35*a*, unlike the chamber 10, and the lower end of the outer tube 37 and the treated surface 35*a* are provided therebetween with the given space 40, whereby the sucking cavitation flow 5 generated at the direct downward of the narrowed portion 27 are applied to the treated surface 35*a* and the tube body 33 is movable on the treated surface 35*a*. Further, unlike the chamber 10, the inner tube 36 and the outer tube 37 are connected to each other at the upper portions thereof so that they are vertically movable, so that the cross-sectional shape or size of the fluid suction passage 39 is not varied.

At this case, a tube plate 37*a* making up of the outer tube 37 is extended lower than the lower end of the inner tube 36, and a processing passage 42 from the narrowed portion 27 to the treated surface 35*a* is interrupted from the processing fluid 8 at the outer side of the outer tube 37, by an extended portion 37*b*. In addition, an extended length 41 as the length of the extended portion 37*b* is configured so that it is changeable by adjusting the vertical relative position of the inner tube 36 and the outer tube 37 or the like, and a distance 42*a* of the processing passage 42 can be set up at the distance that can obtain the crushing impact force of the cavitation bubbles 30 and the colliding force of the particulates 7, by adjusting the extended length 41.

Due to the above construction, when driving the suction pump 17, an internal pressure in the fluid suction passage 39 between the inner tube 36 and the outer tube 37 becomes a negative one, and the processing fluid 8 including the particulates 7 into the fluid supply passage 38 is sucked out approximately perpendicular to the treated surface 35*a* of the treated member 35, through the narrowed pore 27*b*. Accordingly, the flow of the high-speed processing fluid 8 containing the cavitation bubbles 30 is generated at the direct downstream of the narrowed portion 27 as the sucking cavitation flow 5.

The sucking cavitation flow 5 generated descends at high speed, into the processing passage 42, which is interrupted from the processing fluid 8 at the outer side of the outer tube 37 by the extended portion 37*b* and which has little influence from the outside thereof, thereby being able to intensively act the crushing impact force of the cavitation bubbles 30 and the colliding force of the particulates 7 on the treated surface 35*a*, as is the case with the tube body 9. The descending sucking cavitation flow 5 changes the flow direction thereof to the reverse one when attaching the treated surface 35*a*, and ascends into the fluid suction passage 39 having the constant cross-sectional shape or size.

At this state, when driving the actuator 22 of the tube body driving portion 4, the tube body 33, as the double tube type having the fluid supply passage 38 and the fluid suction passage 39, can be moved to the given processing portion and can be scanned at a constant pitch, onto the treated surface 35*a* of the treated member 35 placed on the bottom plate 34*a* of the chamber 34, thereby being able to perform the partial processing or the whole processing of the treated surface 35*a*.

The tube body 33, as the double tube body, integrally consisting of an inner tube 36 having the fluid supply passage 38 therein and having the narrowed portion 27 at one end thereof, and an outer tube 37 having the fluid suction passage 39 during the outer side surface of the inner tube 36, is provided, and the treated surface 35*a* as the treated surface is exposed into the fluid passage in the vicinity of the narrowed portion 27. Accordingly, the surface treating can be applied onto the treated surface 35*a*, by only changing the position of the tube body 33 provided with the fluid supply passage 38 and the fluid suction passage 39 into the chamber 34, even the case when a large chamber is required so as to immerse the treated member 35 as the large treated material in the single tube body, a cross-sectional area of the fluid suction passage surrounding the fluid supply passage is significantly increased, and when a sufficient suction power cannot be obtained by a normal suction pump, thereby being able to secure the high processing accuracy and treatment efficiency and to enlarge the processing size The outer side surface of the inner tube 36 comprising the fluid supply passage 38 can be utilized so as to form the fluid suction passage 39, thereby being able to reduce the component cost due to the decrease in the number of components and to enhancing the maintenance performance. Since the fluid suction passage 39 of the tube body 33 is defined by the inner tube 36 and outer tube 37, the shape or largeness of the cross section of the fluid suction passage 39 can be always kept at constant and the variation of the sucking cavitation flow 5 into the fluid suction passage 39 can be restrained.

As a matter of course, when the treated member 35 is easy to be moved as it is large but light, the tube body 33 may be fixed and the treated member 35 may be moved, or alternatively, the tube body 33 and the treated member 35 may be moved at the same time. The driving construction thereof is not especially limited, as long as the narrowed portion 27 of the tube body 33 can be swiftly and accurately located at the given portion.

Because the outer tube 37 is extended so as to cover the processing passage 42 as the fluid passage from the narrowed portion 27 to the treated surface 35*a* as the processed surface, the influence that the sucking cavitation flow 5 in the processing passage 42 receives from the outside thereof can be minimized, and the distance 42*a* of the processing passage 42 can be set at adequate one, corresponding to the kind or the extent of the surface treating, the kind of the fluid or particulates, the mechanical property of the treated member 35 as the treated material or the like, by changing the extended length 41 of the outer tube 37, thereby being able to further advancing the treating efficiency and the processing accuracy of the surface treating.

Next, another embodiment of the same single tube type as the tube body 9 will be described with reference to FIGS. 4 to 7.

A tube body 43 is a flexible pipe type made up of a flexible material, and is not a plate-like pipe such as the aforementioned treated members 6, 35. The tube body 43 is inserted into the curved pipe-like treated member 44 like a U-shaped pipe, and is intruded inflecting the tube body 43 along the shape of he internal wall of the treated member 44, so as to apply the surface treating to the internal wall.

As shown in FIGS. 4, 5, the tube body 43 is made up of the flexible material like a flexible tube that connects a hose made from a rubber, a vinyl, a plastic or the like, and a plurality of hard materials made from a stainless or the like, having multiple nodes. The tube body 43 is formed therein with a fluid supply passage 46, like the tube body 9. The fluid supply passage 46 is filled with the processing fluid 8 that disperses and mixes the particulates 7. The tube body 43 is closed at the tip thereof with a cover plate 43*a*, and a narrowed portion 45 is formed near the cover plate 43*a*.

Unlike the narrowed portion 27, at the narrowed portion 45, a plurality of small narrowed pores 45*a* are radially opened at regular intervals, on the same circumference parallel to the cover plate 43*a* of a tube plate 43*b* making up of the tube body 43, and the processing fluid 8 supplied to the fluid supply passage 46 flows out to the radial direction of the tube body 43, toward a treated surface 44*a* of the treated member 44, through the narrowed pores 45*a*. In this case, also, the narrowed portion 45 is located opposite to the surrounding treated surface 44*a*, so that the pore axes of the narrowed pores 45*a* become approximately perpendicular to the a treated surface 44*a*.

Meanwhile, a fluid suction passage 47 is formed at space except for the tube body 43 into the treated member 44. The fluid suction passage 47 is filled with the processing fluid 8. A ring-shaped shield plate 48 is fitted with a portion separated from the narrowed portion 45 at midstream of the treated member 44. Accordingly, when sucking the processing fluid 8 into the fluid suction passage 47 from the narrowed portion 45 of the treated member 44 by a suction pump (not shown) to the direction shown by an arrow 49 (hereinafter, referred to as "a sucking direction", the extra processing fluid 8 fails to flow into the upstream of the ring-shaped shield plate 48 in the fluid suction passage 47, so as to increase the suction power of the processing fluid 8 into the fluid suction passage 47 by the suction pump. In this regard, the shield plate 48 is perforated at midportion thereof with a guide pore 48*a*, and the tube body 43 is slidably supported onto the guide pore 48*a*. The tube body 43 can be inserted through the guide pore 48*a* and can be intruded into the sucking direction in the treated member 44.

Due to the above construction, when driving the suction pump (not shown), the processing fluid 8 into the fluid suction passage 47 is sucked toward the sucking direction, and the processing fluid 8 containing the particulates 7 into the fluid supply passage 46 is sucked out approximately perpendicular to the treated surface 44*a* of the treated member 44, through the narrowed pores 45*a*. Accordingly, the flow of the high-speed processing fluid 8 containing the cavitation bubbles 30 is circularly generated around the narrowed portion 45, as a sucking cavitation flow 50 expanding to the radial direction of the tube body 43.

The sucking cavitation flow 50 flows at high speed, and intensively acts the crushing impact force of the cavitation bubbles 30 and the colliding force of the particulates 7 on the treated surface 44*a*. Incidentally, in this case, the suction power by the suction pump is controlled so as to be adequate, so that the sucking cavitation flow 50 flowing laterally to the treated surface 44*a* is not greatly inhibited by the flow of the sucking direction of the processing fluid 8.

Briefly, since the tube body 43 as the single tube body is made up of the flexible, the sucking cavitation flow 50 generated at the direct downstream of the narrowed portion 45 can be applied to the given portion of the treated surface 44*a*, by bending the tube body 43 along the shape of the treated member 44 as the flow passage component of the fluid suction passage 47 which the treated surface 44*a* as the processed surface is exposed therein. Even if the treated member is not a linear shape but is inflective or a complicated shape, the surface treating can be performed by swiftly and accurately moving the narrowed portion 45 to the given portion, thereby being able to secure the high treatment efficiency and processing accuracy and to expand the processing object.

As shown in FIG. 6, the tube body 43 is attached near the narrowed portion 45 thereof to an actuator 51, and a distance 52 of the processing passage from the narrowed portion 45 to the treated surface 44*a* is adjusted by operating the actuator 51 from outside, so that the sucking cavitation flow 50 applied to the treated surface 44*a* is not widely fluctuated according to the position thereof. Examples of the actuator 51 include a movable member (not shown) that can be operated and moved from outside of the treated member 44 by using a magnet or the like, or, as shown in FIG. 7, a supporting member 53, including a roller 53*a* which can roll on the internal wall of the treated member 44 and an extensible portion 53*b* which is connected to the roller 53*a* and which incorporates an elastic member such as an extensible spring or the like. The kind of the actuator 51 is not especially limited, as long as it can accurately and constantly controls the distance 52 of the processing passage, without inhibiting the flow of the processing fluid 8 into the fluid suction passage 47.

Further, the tube body 43 is attached pretty near the narrowed portion 45 thereof to a distance sensor 54 such as an eddy ammeter, and an actual distance 52 of the processing passage is measured by using the distance sensor 54, so that the actuator 51 can be operated and controlled, based on the distance signal.

In this case, while moving the tube body 43 to the sucking direction into the treated member 44, the actuator 51 is driven based on the distance signal from the distance sensor 54, and the distance 52 of the processing passage is controlled at a constant distance, thereby being able to perform the partial processing or the whole processing of the treated surface.

Briefly, the surface treating device of the present embodiment comprises the actuator 51 as the distance retaining means which can constantly retain the distance 52 from the narrowed portion 45 to the treated surface 44*a* as the treated surface, so that the crushing impact force of the cavitation bubbles 30 or the colliding force of the particulates 7 can be evenly acted over the whole treated surface 44*a*, so as to performing the homogeneous surface treating.

Further, the surface treating device of the present embodiment comprises the distance sensor 54 which can detect the distance 52 from the narrowed portion 45 to the treated surface 44*a* as the processed surface, the distance 52 from the narrowed portion 45 to the treated surface 44*a* as the processed surface can be retained at an adequate value with higher accuracy, based on a distance signal from the distance sensor 54, thereby being able to further advancing the treating efficiency and the processing accuracy.

Next, another embodiment of the surface treating device will be described with reference to FIG. 8.

In the surface treating device 50, as shown in FIG. 8, a part of the processing fluid circulating portion 3 in the construction of the surface treating device 1 is changed. Specifically, a pressure feeding pump 55 as the pressure feeding means connected to a motor 56 is interposed at midportion of the pipe 14 communicating with each of the storage tank 21 and the supply port 15 opened in the tube body 9. Since the components except for the pressure feeding pump 55 connected to the motor 56 is the same as the surface treating device 1 as mentioned above, description on these components will be omitted.

As described above, in the processing fluid circulating portion 3, the suction port 11 opened in the chamber 10 is communicated with the suction port of the suction pump 17 through the pipe 12, and the discharge port of the suction pump 17 is communicated with the storage tank 21 via the pipe 13. By driving the suction pump 17 using the motor 18, the processing fluid 8 into the chamber 10 is swiftly sucked from the suction port 11 into the pipe 12, passes through the pipe 12, the suction pump 17 and the pipe 13 in this order, and the foreign substances such as the coarse processed debris are removed through the screen filter 19 provided at midstream of the pipe 13, so as to be flown and stored in the storage tank 21.

In the processing fluid circulating portion 3, also, the storage tank 21 is communicated at the lower end thereof with the suction port of the pressure feeding pump 55 through the pipe 14 (14*a*), and the discharge port of the pressure feeding pump 55 is communicated with the supply port 15 opened in the tube body 9 through the pipe 14 (14*b*). By driving the pressure feeding pump 55 due to the motor 56, the processed fluid 8 in the storage tank 21 is swiftly sucked into the tube body 9 through the pipes 14 (14*a*, 14*b*) and the supply port 15, and the processed fluid 8 is swiftly blown out approximately perpendicular to the treated surface 6*a* of the treated member 6 through the narrowed portion 27.

In this regard, the pipe 14*b* is interposed at midstream thereof with a pressure gauge 58, and the pressure feeding pump 55 is controlled so as to be the predetermined discharge force, by the pressure gauge 58.

Thus, due to the construction of the surface treating device 50, when driving the suction pump 17 and the pressure feeding pump 55 at the same time, the inner pressure of the fluid suction passage 26 communicating with the suction pump 17 via the pipe 12 becomes the negative pressure, and the processing fluid 8 containing the particulates 7 in the fluid supply passage 25 is sucked out approximately perpendicular to the treated surface 6*a* of the treated member 6, through the narrowed pore 27*b*. At the same time, the inner pressure of the tube body 9 communicating with the pressure feeding pump 55 arranged at upstream of the fluid supply passage 25 via the pipe 1 is increased, and the processing fluid 8 containing the particulates 7 in the tube body 9 is swiftly blown out approximately perpendicular to the treated surface 6*a* of the treated member 6, through the narrowed pore 27*b*. Then, the processing fluid 8 increases the flow velocity thereof when passing through the narrowed pore 27*b*, and accordingly, the pressure is lowered, and the pressure is decreased up to the saturated vapor pressure of the processing fluid 8, whereby the cavitation bubbles 30 are generated. Consequently, the high-pressure flow of the processing fluid 8 containing the cavitation bubbles 30 are generated at the direct downstream of the narrowed portion 27 as the sucking cavitation flow 5.

The sucking cavitation flow 5 lowers the flow velocity thereof and retrieves the pressure thereof, while it drops from the narrowed pore 27*b* to the treated surface 6*a*, and the cavitation bubbles 30 contained are crushed so as to generate the crushing impact force as mentioned above. The crushing impact force directly acts approximately perpendicular to the treated surface 6*a*, and acts on the particulates 7 moving at high speed to the treated surface 6*a* on the sucking cavitation flow 5, thereby further accelerating the particulates 7 so as to vigorously crushing approximately perpendicular to the treated surface 6*a*.

The processing flow of the sucking cavitation flow 5 that dropped near the treated surface 6*a* gradually spreads outward and changes the flow direction to the reverse one so as to move upwards into the fluid suction passage 26. The vortex is generated between the upward flow and the downward one, and in the vortex, the flow velocity is lowered so as to cause the stagnation, as well as the solid particulates 7 remain at the stagnation, thereby increasing the mixing ratio of the particulates 7 near the treated surface 6*a* and increasing the number of the particulates 7 crushing the treated surface 6*a*.

Briefly, the sucking cavitation flow 5 can be more intensively crushed on the treated surface 6*a* as the processed surface, by sucking the processing fluid 8 as the fluid in the fluid supply passage 25 using the suction pump 17 as the suction means and by pressurizing and sending the processing fluid 8 in the fluid supply passage 25 using the pressure feeding pump 55 as the pressure feeding means, thereby being able to further advancing the surface treating speed and the processing speed.

Next, another embodiment of the narrowed portion 27 will be described with reference to FIG. 9.

As shown in FIG. 9, a narrowed portion 57, including a plug 27*a* perforated a narrowed pore 27*b*, is provided in the narrowed pore 27*b* with an opening and closing valve 59 for opening or closing the narrowed pore 27*b*.

Due to the construction of the narrowed portion 57, with the opening and closing valve 59 of the narrowed portion 57 preliminarily closed, after pressurizing and sending the processing fluid 8 as the fluid in the fluid supply passage 25 by the pressure feeding pump 55 as the pressure feeding means and making the inner pressure in the fluid supply passage 25 higher than the inner pressure in the fluid suction passage, the opening and closing valve 59 of the narrowed portion 57 is opened, whereby the inner pressure in the fluid suction passage 26 further becomes the negative pressure, in comparison to the case of the narrowed portion 27 without the opening and closing valve 59. Consequently, the processing fluid 8 containing the particulates 7 in the fluid supply passage 25 is swiftly sucked out approximately perpendicular to the treated surface 6*a* of the treated member 6, through the narrowed pore 27*b*. Accordingly, the high-pressure sucking cavitation flow can be crushed onto the treated surface, so as to enhance the surface treating speed and the processing speed.

The porous member, the inducing member and the fluid swirling member, as members provided near the downstream opening portion of the narrowed portion, will be described with reference to FIGS. 10 to 12.

As shown in FIG. 10, in a mesh member 60 having multiple pores, as the porous member, linear members having square shapes with cross-sectional view are crisscross interweaved. The mesh member 60 can be provided, for example, near each of the downstream opening portions of the narrowed pores 27*b* of the aforementioned narrowed portions 27 and 57. By providing the mesh member 60 near each of the downstream opening portions of the narrowed portions 27 and 57, generating portions of the cavitation bubbles 30 are increased due to the multiple pores of the mesh member 60, thereby being able to improve the generating efficiency of the cavitation bubbles 30 and to enhance the surface treating efficiency.

Incidentally, with regard to the narrowed pores 45*a* opened at the foregoing flexible tube body 43, the same effects as mentioned above can be achieved, by providing the mesh member so as to cover the narrowed pores 45*a*.

The linear members having square shapes with cross-sectional view comprising the mesh member 60 may be configured so that the surface thereof has microscopic bosses. By providing these bosses, generating portions (origins) of the cavitation bubbles 30 are further increased, thereby being able to improve the generating efficiency of the cavitation bubbles 30 and enhance the surface treating efficiency.

As shown in FIG. 11, the inducing member 61 is a cylindrical member having a tapered through-bore 61*a* therein. A diameter of the upstream opening portion (the upper opening portion in FIG. 11) of the through-bore 61*a* is configured so as to be equal to that of each of the downstream opening portions (the lower opening portions in FIG. 11) of the narrowed portions 27 and 57. A diameter of the downstream opening portion of the through-bore 61*a* is larger than that of the upstream opening portion of the through-bore 61*a*. The upper surface of the inducing member 61 is provided so as to attached to each of the lower surfaces of the narrowed portions 27 and 57, near each of the downstream opening portions of the narrowed pores 27*b* of the aforementioned narrowed portions 27 and 57, as well as the narrowed portion 27 or 57 is configured integral with the inducing member 61, so that the sucking cavitation flow 5 discharged from the narrowed pores 27*b* can be induced along a tapered portion as the internal surface of the through-bore 61*a* of the inducing member 61.

By providing the inducing member 61 near the downstream opening portion of the narrowed portion 27 or 57, for example, as shown in FIG. 11, when processing the internal surface of a through-bore 62*a* of a cylindrical member 62 having the through-bore 62*a* therein, as a treated surface 62*b*, an inner diameter of the through-bore 61*a* of the inducing member 61 is configured so as to be equal to that of the through-bore 62*a* of the cylindrical member 62 as the treated member, and the sucking cavitation flow 5 is generated from the narrowed pores 27*b*, so that the sucking cavitation flow 5 is induced by the tapered portion of the inducing member 61 and flows to the direction of arrows in FIG. 11, thereby being able to perform the processing treatment for the treated surface 62*b* as the internal surface of the through-bore 62*a* of the cylindrical member 62.

Thus, by providing the inducing member 61 for inducing the sucking cavitation flow 5 to the given direction, near the downstream opening portion of the narrowed portion, the sucking cavitation flow 5 is induced to the specific portion of the treated member, thereby being able to enhance the surface treating efficiency.

As shown in FIGS. 12 (*a*), (*b*), a fluid swirling member 63 is a member having a cylindrical outer shape consisting of multiple flexible blades 63*a*, and the fluid swirling member 63 is fixedly provided at the periphery thereof with a bearing 63*b*. The periphery of the bearing 63*b* is attachable to the lower end portion of the tube body 9. When the sucking cavitation flow 5 flows, with the fluid swirling member 63 fixedly provided at the lower end portion of the tube body 9 (the narrowed portion 27 or 57), the fluid swirling member 63 is rotatable depending on the flow of the sucking cavitation flow 5. Due to the above construction, the sucking cavitation flow 5 discharged from the narrowed portion 27 (the narrowed portion 57) swirls to the given direction, and crushes the particulates 7 approximately perpendicular to the treated surface 6*a* as the processed surface, thereby being able to prevent the generation of discharge unevenness of the sucking cavitation flow 5 and approximately uniformly perform the processing treatment for the processed surface.

Thus, the narrowed portion 27 or 57 is provided near the downstream opening portion thereof with the fluid swirling member 63 as the fluid swirling means, so that the sucking cavitation flow 5 can be swirled toward the treated surface 6*a* to the given direction and can be crushed into it, thereby being able to prevent the unevenness of the surface treating and to evenly perform the surface treating.

In the surface treating device 1 or the surface treating device 50 as mentioned above, the treating portion 2 may be provided in the chamber 10 thereof with a temperature control means for controlling the temperature of the processing fluid 8 as the fluid. For example, the generation of the cavitation bubbles 30 is enhanced at the narrowed pore 27*b*, by heating the processing fluid 8 at the predetermined temperature using the temperature control means, thereby being able to increase the cavitation bubbles 30 and to improve the processing treatment speed.

In other words, the temperature of the processing fluid 8 as the fluid is controlled to the predetermined temperature, so as to control the temperature state easy to generate the cavitation bubbles 30 and increase the cavitation bubbles 30, thereby being able to improve the surface treating efficiency.

Instead of providing the opening and closing valve 59 in the narrowed portion 57, or in addition to the opening and closing valve 59, for example, as a diaphragm of a photographic camera, the narrowed portion 27 (the narrowed portion 57) may be provided at the given position thereof with the pore diameter variable means having a function for opening and closing the narrowed pore 27*b* and a function for changing the pore diameter of the narrowed pore 27*b* (not shown). By providing the pore diameter variable means, the extent of the impact of the sucking cavitation flow 5 on the treated surface 6*a* of the treated member 6 can be continuously adjusted, so as to control the processing configuration.

[Industrial Applicability]

The present invention is applicable in all surface treating methods, which generates a sucking cavitation flow containing the cavitation bubbles, by sucking, or sucking and spraying the fluid via a narrowed portion provided at midstream of the flow passage, and which acts the crushing impact force of the cavitation bubbles on the treated surface in the vicinity of the narrowed portion, into the sucking cavitation flow, as well as all surface treating devices for performing the surface treating methods.

What is claimed is:

1. A treating device, comprising:

a fluid supply passage having a narrowed portion at one end thereof;

a fluid suction passage fluidly connected to the fluid supply passage through the narrowed portion, wherein the narrowed portion includes a pore axis that is configured to generate a sucking cavitation flow containing cavitation bubbles by sucking fluid through the narrowed portion, and wherein the narrowed portion is configured to use the sucking cavitation flow as a crushing impact force on a surface to be treated; and a suction means configured to suck fluid in the fluid suction passage, wherein the fluid suction passage approximately concentrically surrounds the periphery of the fluid supply passage, and wherein the pore axis of the narrowed portion is configured to be approximately perpendicular to the surface to be treated.

2. The treating device as set forth in claim 1, wherein the surface treating device is configured to distribute and mix particulates with the fluid and to provide a crushing impact flow including the particulates.

3. The treating device as set forth in claim 1, wherein the fluid supply passage is in the form of a single tube body and is provided at one end thereof with the narrowed portion, and wherein the surface to be treated is exposed to the fluid suction passage outside of the fluid supply passage.

4. The treating device as set forth in claim 1, wherein the single tube body is made of a flexible pipe.

5. The treating device as set forth in claim 1, wherein the fluid supply passage and the fluid suction passage are in the form of a double tube body including an inner tube and an outer tube, wherein the fluid supply passage is the inner tube, and the fluid suction passage is the outer tube, and wherein the surface to be treated is exposed to the fluid passage in the vicinity of the narrowed portion.

6. The treating device as set forth in claim 5, wherein the outer tube covers the fluid passage between the narrowed portion and the surface to be treated.

7. The treating device as set forth in claim 1, further comprising:

a distance retaining means configured to constantly retain a distance between the narrowed portion and the surface to be treated.

8. The treating device as set forth in claim 1, further comprising:

a distance sensor configured to detect the distance from the narrowed portion to the surface to be treated.

9. The treating device as set forth in claim 1, wherein a portion of the surface to be treated is covered with a masking member.

10. The treating device as set forth in claim 1, wherein the narrowed portion is configured so as to be freely movable on the surface to be treated.

* * * * *